US006095282A

United States Patent [19]

Sadeck

[11] Patent Number: 6,095,282

[45] **Date of Patent: *Aug. 1, 2000**

[54] RAPPEL TOOL FOR DESCENT OF A LOAD AND RAPPEL TOOL AND STIRRUP ASSEMBLY FOR ASCENT ALONG A RAPPEL ROPE

[75] Inventor: James E. Sadeck, East Freetown, Mass.

[73] Assignee: The United States of America as represented by the Secretary of the Army, Washington, D.C.

[ * ] Notice: This patent issued on a continued prosecution application filed under 37 CFR 1.53(d), and is subject to the twenty year patent term provisions of 35 U.S.C. 154(a)(2).

[21] Appl. No.: 09/383,300

[22] Filed: Aug. 25, 1999

Related U.S. Application Data

[63] Continuation of application No. 08/992,979, Dec. 18, 1997, abandoned.

[51] Int. Cl.[7] ..... A47L 3/04

[52] U.S. Cl. ..... 182/6; 182/191; 188/65.4

[58] Field of Search ..... 182/3, 5, 6, 7, 182/9, 72, 191; 188/65.1, 65.2, 65.4, 65.5

[56] References Cited

U.S. PATENT DOCUMENTS

| | | | |
|---|---|---|---|
| 316,870 | 4/1885 | Braunfeld | 188/65.4 |
| 505,706 | 9/1893 | Fowler | 182/191 |
| 553,190 | 1/1896 | Fowler | 182/191 |
| 682,082 | 9/1901 | Ives | 182/7 |
| 785,019 | 3/1905 | Parker | 188/65.4 |
| 890,898 | 6/1908 | Gaillac | 182/191 |
| 3,217,840 | 11/1965 | Holkesvick | 182/5 X |
| 3,678,543 | 7/1972 | Hobbs | 182/191 |
| 3,695,397 | 10/1972 | Hobbs | 182/5 X |
| 3,757,901 | 9/1973 | Hobbs | 182/5 X |
| 3,869,021 | 3/1975 | Sutherland et al. | 182/3 |
| 4,311,218 | 1/1982 | Steffen | 182/5 X |
| 4,678,059 | 7/1987 | Bowker | 182/5 |
| 4,723,634 | 2/1988 | Fisk | 188/65.4 |
| 4,934,484 | 6/1990 | Green et al. | 182/5 |
| 5,145,036 | 9/1992 | Omalia | 182/72 X |
| 5,217,092 | 6/1993 | Potter | 188/65.4 |
| 5,352,172 | 10/1994 | Suzaki | 182/5 X |

*Primary Examiner*—Daniel P. Stodola
*Assistant Examiner*—Richard M. Smith

[57] ABSTRACT

A rappel tool for use in conjunction with rappel rope, the tool comprising a generally rectangularly-shaped and substantially planar rigid body having first and second side edges and first and second end edges. A first opening extends through the body and is proximate and spaced from the first end edge and is spaced from the first and second side edges. A second opening extends through the body and is proximate and spaced from the second end edge and is spaced from the first and second side edges. A third opening extends through the body and is disposed between the first and second openings and is spaced from the first and second side edges. Each of the openings is of sufficient size to permit passage therethrough of a plurality of rappel ropes of a diameter of no more than about nine millimeters.

1 Claim, 4 Drawing Sheets

RAPPEL TOOL FOR DESCENT OF A LOAD AND RAPPEL TOOL AND STIRRUP ASSEMBLY FOR ASCENT ALONG A RAPPEL ROPE

This application is a continuation of application Ser. No. 08/992,979 filed on Dec. 18, 1997, now abandoned.

BACKGROUND OF THE INVENTION

1. Field of the Invention

The invention relates to descending and ascending loads along a rope and is directed more particularly to a tool and method for descent of a load along a rappel rope, and a rappel tool and stirrup assembly for ascent along a rappel rope.

2. Description of the Prior Art

Rappel tools are generally known in the art, but are generally configured for a particular size of rappel rope and a particular configuration of rappel rope therearound and therein for a particular braking capacity. In short, rappel tools are configured for a specific task and are therefore often not adaptable for use with respect to other tasks.

There is a need for a rappel tool which finds utility with different sizes of rappel rope, with descending and ascending loads, with movement of people as well as materials, and which is of small and sturdy construction so as to be suitable for inclusion in a back pack, or the like, with addition of minimal weight and consumption of minimal space.

SUMMARY OF THE INVENTION

An object of the invention is, therefore, to provide a rappel tool and methods for descent of loads, either personnel or materials, along a rappel rope.

A further object of the invention is to provide such a tool in combination with a stirrup assembly for ascent of personnel along a rappel rope.

With the above and other objects in view, as will hereinafter appear, a feature of the invention is the provision of a rappel tool for use in conjunction with a rappel rope, the tool comprising a generally rectangularly-shaped and substantially planar rigid body having first and second side edges and first and second end edges. A first opening extends through the body and is proximate and spaced from the first end edge and is spaced from the first and second side edges. A second opening extends through the body and is proximate and spaced from the second end edge and is spaced from the first and second side edges. A third opening extends through the body and is disposed between the first and second openings and is spaced from the first and second side edges. Each of the openings is of sufficient size to permit passage therethrough of plurality of rappel ropes of a diameter of no more than about nine millimeters.

In accordance with a further feature of the invention, there are provided methods for handling rappel rope for descent of a load connected thereto, the method utilizing the tool described immediately above and a rappel rope, interconnecting the tool and rappel rope such that an operator grasping the rappel rope can exert a braking force during descent of the load.

In accordance with a further feature of the invention, there is provided a rappel tool and foot stirrup assembly comprising the rappel tool described above, a rappel rope extending alongside the rappel tool, and a chord forming a closed loop interengaged with the tool so as to form a stirrup for a foot of a person ascending the rappel rope.

The above and other features of the invention, including various novel details of construction and combinations of parts, will now be more particularly described with reference to the accompanying drawings and pointed out in the claims. It will be understood that the particular device and methods embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENTS

Figure 2:
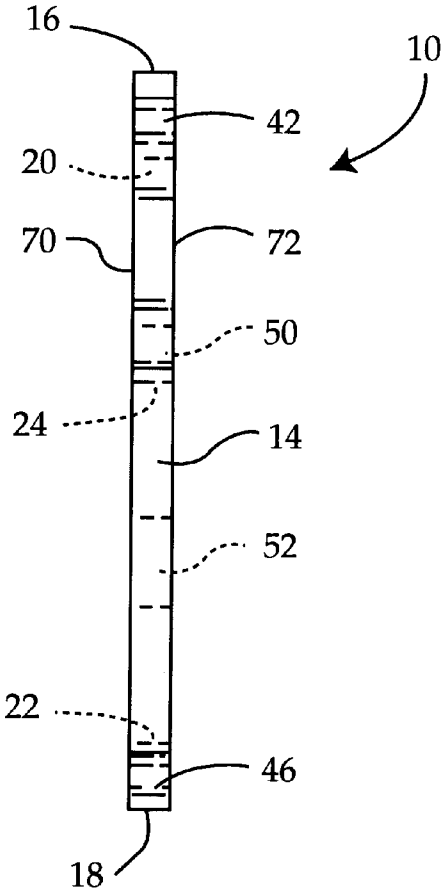
FIG. 2 is a side-elevational view of the tool of FIG. 1.
Figure 1:
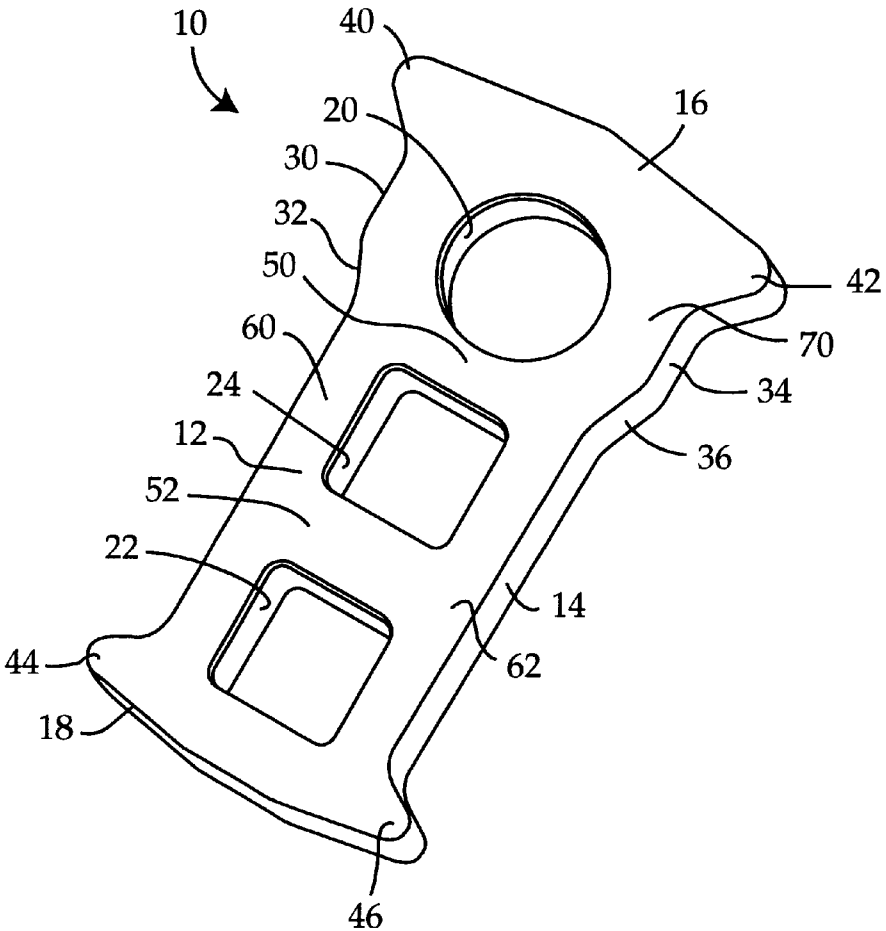
FIG. 1 is a perspective view of one form of rappel tool illustrative of an embodiment of the invention.

Referring to FIGS. 1 and 2, it will be seen that the illustrative rappel tool comprises a generally rectangularly shaped and substantially planar rigid body 10 having first and second side edges 12, 14 and first and second end edges 16, 18.

A first opening 20 extends through the body 10 and is proximate to, and spaced from, the first end edge 16 and is spaced from the first and second side edges 12, 14. A second opening 22 extends through the body 10 and is proximate to, and spaced from, the second end edge 18 and is spaced from the side edges 12, 14. A third opening 24 extends through the body 10 and is disposed between the first and second openings 20, 22 and is spaced from the side edges 12, 14. Each of the openings 20, 22, 24 is of sufficient size to permit passage therethrough of at least a pair of rappel ropes of no more than about 9 mm, and preferably four ropes of such size.

A first shoulder 30 is disposed on the first side edge 12 and comprises an extension of the planar body 10, the extension being formed by an inclined first side edge surface 32 extending toward the first end edge 16 and outwardly. Similarly, a second shoulder 34 is disposed on the second side edge 14 and comprises a further extension of the planar body 10, the further extension being formed by an inclined second side edge surface 36 extending toward the first end edge 16 and outwardly, oppositely from the first shoulder 30.

A first outwardly extending ear 40 is formed at a juncture of the first side edge 12 and the first end edge 16. A second outwardly extending ear 42 is formed at a juncture of the second side edge 14 and the first end edge 16. A third outwardly extending ear 44 is formed by a juncture of the first side edge 12 and the second end edge 18, and a fourth outwardly extending ear 46 is formed by a juncture of the second side edge 14 and the second end edge 18.

In a preferred embodiment, the first opening 20 is round in configuration and the second and third openings 22, 24 are generally rectangular with rounded corners. The openings 20, 22, 24 are in alignment with each other lengthwise of the body 10 and are spaced from each other to define a first cross bar 50 between the first and third openings 20, 24, and a second cross bar 52 between the second and third openings 22, 24.

Similarly, the openings 20, 22, 24 are spaced from the first and second side edges 12, 14 to define first and second side bars 60, 62.

The rappel tool body 10 preferably is of a rigid high-strength material, such as carbon steel or a steel alloy. The body is provided with first and second flat surfaces 70, 72 (FIG. 2).

It is preferred that the first and second openings 20, 22 be of sufficient size to receive a carabiner 80 (FIG. 3) or other connector device, such that the tool may thereby be attached to a rappel belt or harness of a wearer.

The tool is provided for use with high strength, small diameter rappel rope (3 mm–5 mm diameter) and moderate diameter rappel rope (7 mm–9 mm). The tool is of less than four inches in length, preferably about 3 ⅝ inches in length.

There is thus provided a rappel tool which finds utility with different sizes of rappel rope, and which is of small and sturdy construction and suitable for inclusion in back pack, or the like, with minimal addition of weight and minimal space requirements.

Figure 3:
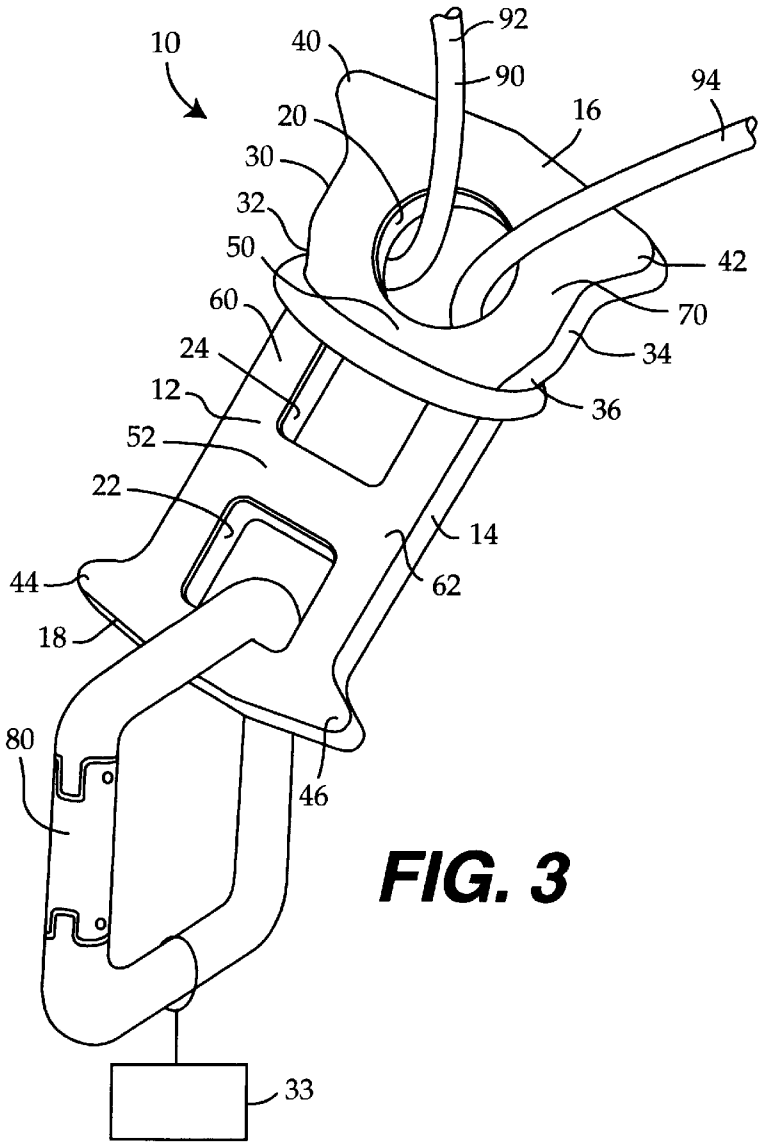
FIG. 3 is a perspective view illustrative of a method for handling rappel rope for descent of a load, utilizing the tool of FIG. 1.

In FIGS. 2–6, there are shown several preferred methods for handling rappel rope using the above-described tool. Referring to FIG. 3, there is shown rappel rope 90, preferably of 7–9 mm diameter, used in conjunction with the tool. The rope 90 includes a portion 92 for connection to a support (not shown) and for bearing the weight of the person, or other load 33, connected to the tool, and a portion 94 which is held by the person descending, or other operator, to create the braking force necessary to control the rate of descent.

To handle the rappel rope 90 as shown in FIG. 3, the rappel rope is prepared, in cooperation with the tool, by extending the rappel rope across the first flat surface 70 proximate the first end edge 16, further extending the rappel rope through the first opening 20 to the second flat surface 72 (FIG. 2), further extending the rappel rope around the first side edge 12 at an inner-most end of the first shoulder 30, further extending the rappel rope across the first surface 70 to an inner-most end of the second shoulder 34, further extending the rappel rope around the second side edge 14 to the second flat surface 72, and further extending the rappel rope through the first opening 20 to the first flat side 70 and outwardly beyond the first end edge 16 for grasping by a person for exerting a braking force during descent of the load.

When assembled as described immediately above, the descending person to which the tool is connected by carabiner 80, permits the rope 90 to slip through the tool with braking effected by the shoulders 30, 34 and the first opening 20. The ears 40, 42 prevent the rope looped around the tool from slipping off the first end 16 of the tool if the rope first slips over the shoulders 30, 34.

Figure 4:
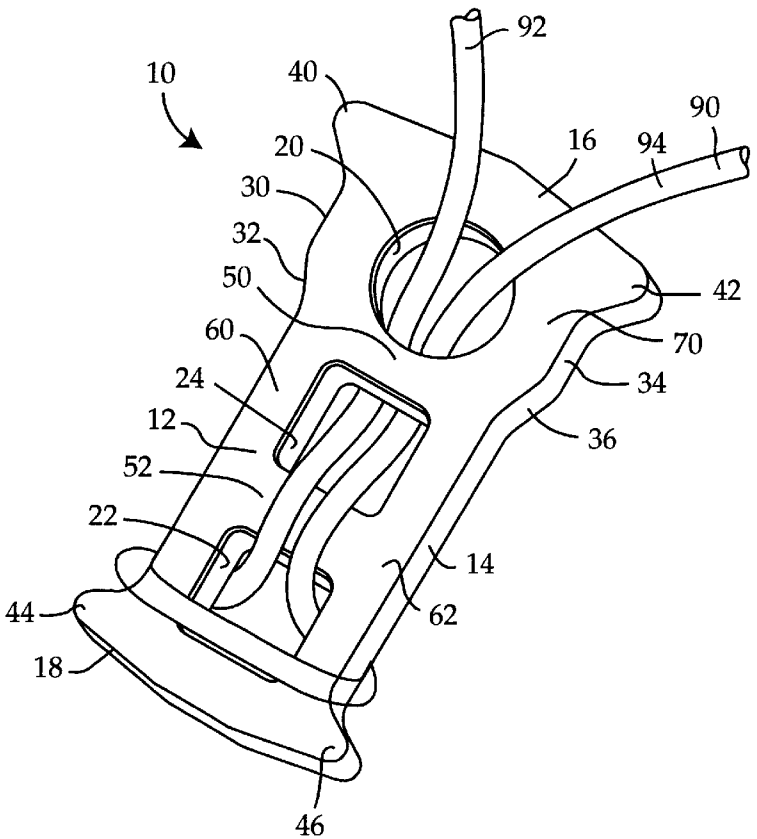
FIGS. 4–6 are similar to FIG. 3 but illustrative of alternative methods.

In FIG. 4, there is shown an alternative method of handling the rope 90 preparatory to a rapelling operation. To handle the rappel rope 90 as shown in FIG. 4, the rope, preferably of 4 or 5 mm diameter, is prepared by extending the rappel rope across the first flat surface 70 proximate the first end edge 16, further extending the rappel rope through the first opening 20 to the second flat surface 72 (FIG. 2), further extending the rappel rope across the first bar 50 on the second flat surface 72 and through the third opening 24 to the first flat surface 70, further extending the rappel rope across the second bar 52 on the first flat surface 70 and through the second opening 22 to the second flat surface 72, further extending the rappel rope around the first side edge 12 adjacent the third ear 44 and across the first surface 70 to the second side edge 14 adjacent the fourth ear 46, further extending the rappel rope across the second surface 72 to and through the second opening 22 to the first surface 70, further extending the rappel rope across the second bar 52 and on the first surface 70 to and through the third opening 24 to the second surface 72, further extending the rappel rope across the first bar 50 and on the second surface 72 to and through the first opening 20, and further extending the rappel rope across the first surface 70 and outwardly beyond the first end edge 16 for grasping by a person for exerting a braking force during descent of the load.

When assembled as shown in FIG. 4, the descending person permits the rope 90 to slip through the tool with braking effected by the cross bars 50, 52, the side edges 12, 14 and side bars 60, 62, and the first opening 20.

Figure 5:
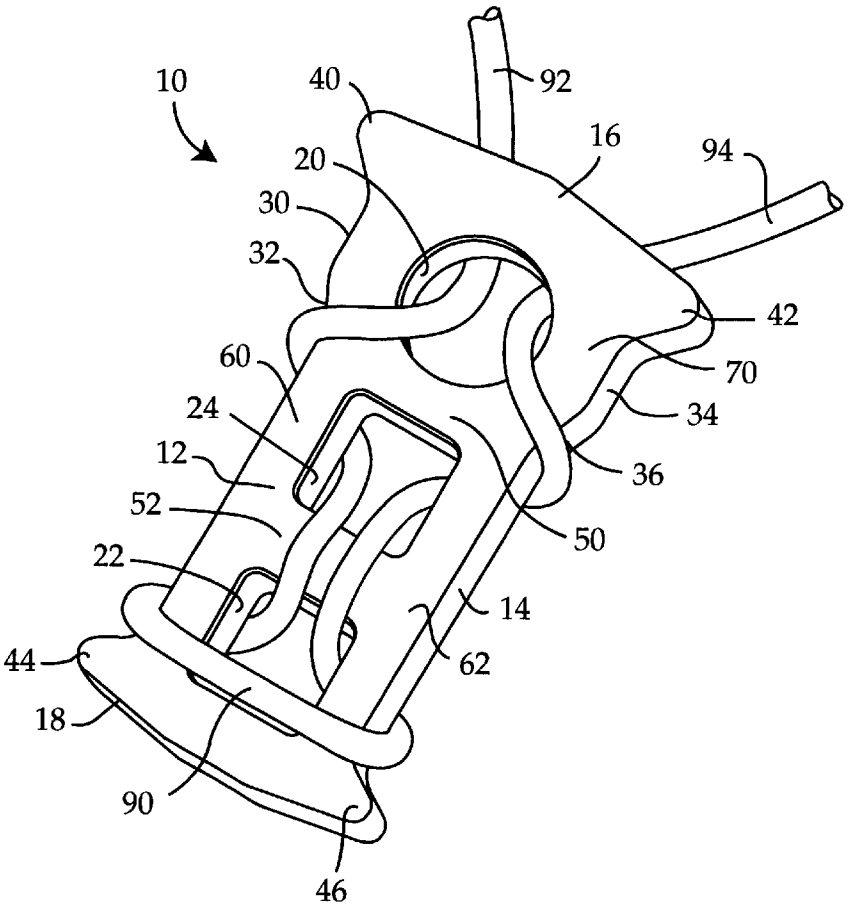

In FIG. 5, there is shown another alternative method of handling the rope 90 wherein the rope is of about 3 or 4 mm diameter and is positioned by extending the rappel rope from the second flat side 72 (FIG. 2) of the body 10 proximate the first end edge 16 through the first opening 20 to the first flat side 70, further extending the rappel rope across the first flat side 70 to an inner-most portion of the first shoulder 30 and around the first side edge 12 to the second flat surface 72, further extending the rappel rope across the first side bar 60 and on the second flat surface 72 to and through the third opening 24 to the second cross bar 52, further extending the rappel rope across the second cross bar 52 on the first flat side 70 and to and through the second opening to the first side bar 60, further extending the rappel rope across the first side bar 60 and on the second flat surface 72, around the first side edge 12 and across the first flat surface 70 to the second side edge 14, further extending the rappel rope around the second side edge 14 and across the second side bar 62 on the second flat surface 72 to and through the second opening 22, further extending the rappel rope across the second cross bar 52 on the first flat surface 70 to and through the third opening 24 to the second flat side 72, further extending the rappel rope across the second side bar 62 on the second flat surface 72 and around the second side edge 14 on an inner-most portion of the second shoulder 34 to the first flat surface 70, further extending the rappel rope across the first flat surface 70 to and through the first opening 20 to the second flat surface 72 and outwardly beyond the first end edge 16 for grasping by a person for exerting a braking force during descent of the load.

When assembled in accordance with FIG. 5, the descending person, or operator if the descending load is not a person, controls slippage of the rope through the tool with braking effected by the side bars 60, 62, the cross bar 52, and the first opening 20.

Figure 6:
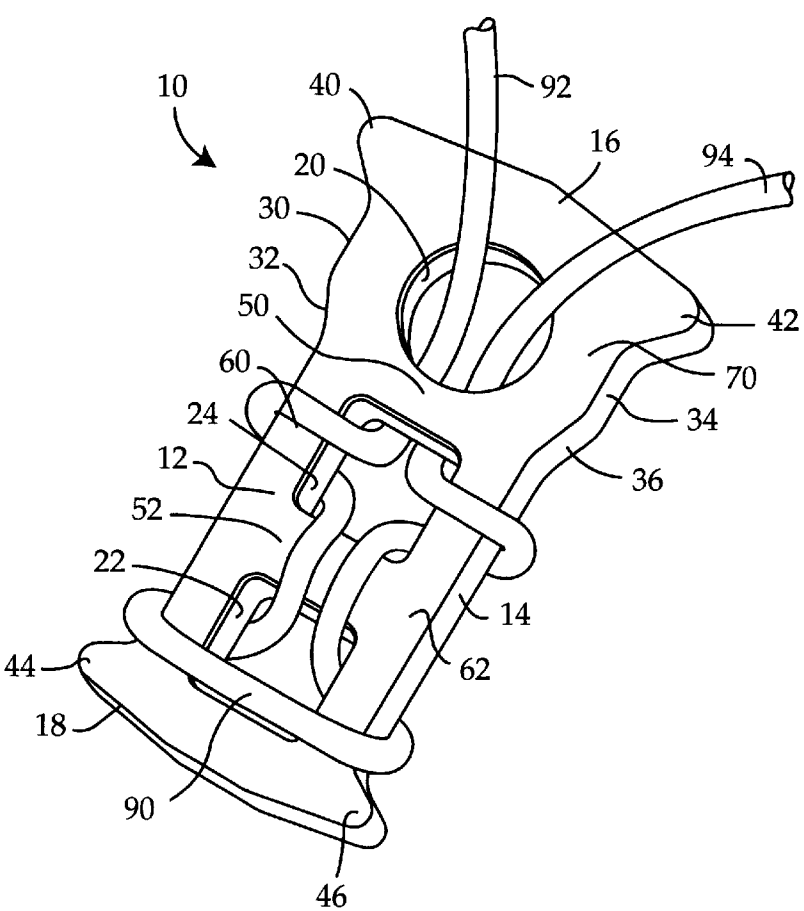

In FIG. 6, there is shown still another alternative method for handling the rope wherein the rope is of about 3 or 4 mm diameter, and is positioned by extending the rappel rope across the first flat surface 70 proximate the first end edge 16, further extending the rappel rope through the first opening 20 to the second flat surface 72 (FIG. 2), extending the rappel rope across the first cross bar 50 and on the second flat surface 72 to and through the third opening 24 to the first flat surface 70, further extending the rappel rope across the first side bar 60 on the first flat surface 70 to and around the first side edge 12, further extending the rappel rope across the first side bar 60 on the second flat surface 72 to and through the third opening 24 to the first flat surface 70, further extending the rappel rope across the second cross bar 52 on the first flat surface 70 to and through the second opening 22 to the second flat surface 72 and around the first side edge 12 proximate the third ear 44, further extending the rappel rope across the first flat surface 70 to and around the second side edge 14 proximate the fourth ear 46, further extending the rappel rope across the second side bar 62 and on the second flat surface 72 to and through the second opening 22 to the first flat surface 70, further extending the rappel rope across the second cross bar 52 and on the first flat surface 70 to and through the third opening 24 to the second flat surface 72, further extending the rappel rope across the second side bar 62 on the second flat surface 72 to and around the second side edge 14 and across the second side bar 62 on the first flat surface 70 to and through the third opening 24 to the second flat surface 72, and further extending the rappel rope across the first cross bar 50 on the second flat surface 72 to and through the first opening 20 and outwardly beyond the first end edge 16 for grasping by a person for exerting a braking force during descent of the load.

When assembled as shown in FIG. 6, the operator permits the rope 90 to slip through the tool with braking effected by the cross bars 50, 52, the side bars 60, 62, and the first opening 20.

It will be apparent that other alternative methods for handling the rappel rope on the tool are available.

There is thus provided methods for rappel rope based descent of loads, either personnel or materials.

Figure 7:
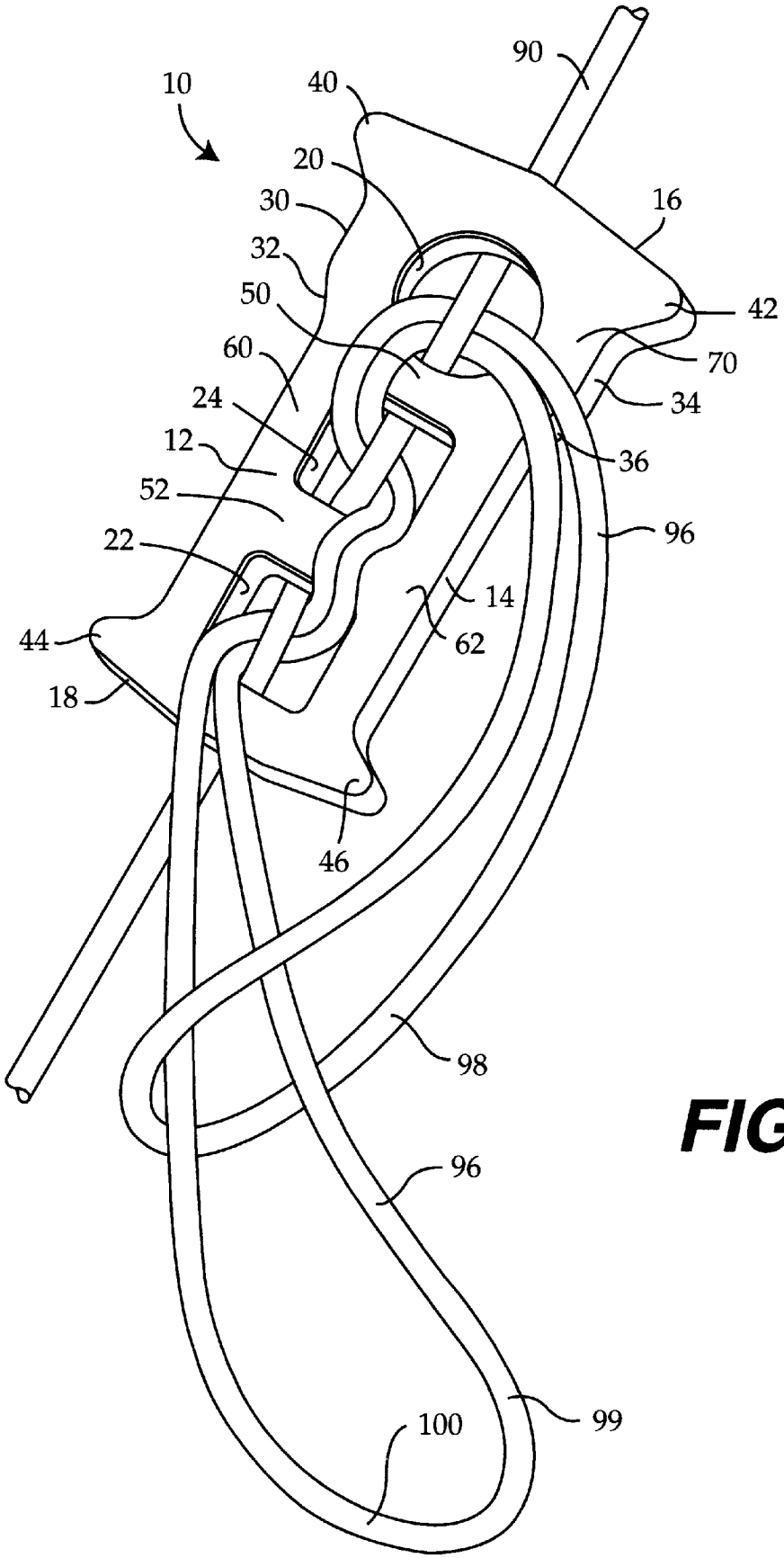
FIG. 7 is a perspective view of one form of rappel tool and foot stirrup.

Referring to FIG. 7, it will be seen that the tool can be used in conjunction with the rappel rope 90 and an accessory cord loop 96 for supporting a person ascending along the rope 90. The tool body 10 is placed against the rope 90 and the cord loop 96 is fed through the tool openings 20, 22, 24 and around the rope 90, more specifically, by extending the cord loop 96 from the first flat surface 70 through the first opening 20 and around the rappel rope 90 which is adjacent the second flat surface 72 (FIG. 2) and back through the first opening 20 to the first flat surface 70, the cord loop 96 further extending from the first opening 20 across the first flat surface 70 of the first cross bar 50 to and through the third opening 24 and around the rappel rope 90 and back through the third opening to the first flat surface 70, the cord loop 96 further extending across the first flat surface 70 of the second cross bar 52 to and through the second opening 22 and around the rappel rope 90 and back through the second opening 22 to the first flat surface 70, a first end portion 98 of the loop 96 extending from the first opening 20 and a second end portion 99 of the cord loop 96 extending from the second opening 22, and the second end portion 99 of the cord loop 96 extending through the first end portion 98 of the loop 96 to form a stirrup 100 for a foot of a person ascending the rappel rope 90. The combination shown in FIG. 7, together with a second like combination in side-by-side arrangement, facilitates ascending on two rappel ropes, each of the assemblies, in turn, being loosened and raised while the other assembly holds fast by virtue of the weight of the ascendor in the stirrup tightening the grip of the cord loop 96 on the rope 90. Alternatively, two tool and cord combinations, each as shown in FIG. 7, may be used on the single rappel rope 90, each tool and cord assembly being moved upwardly on the rope 90 while the other tool and cord assembly is supporting the ascendor.

There is thus provided a tool which in combination with an accessory chord forming a stirrup-providing loop, enables ascent of an individual along a pair of rappel ropes.

It is to be understood that the present invention is by no means limited to the particular construction and method steps herein disclosed and/or shown in the drawings, but also comprises any modifications or equivalents within the scope of the claims.

What is claimed is:

1. A rappel tool and foot stirrup assembly in combination with a rappel rope, the assembly comprising:

a rappel tool for disposition alongside the rappel rope, said tool comprising:

a generally rectangularly-shaped and substantially planar rigid body having first and second side edges and first and second end edges;

a first opening extending through said body and proximate and spaced from said first end edge and spaced from said first and second side edges;

a second opening extending through said body and proximate and spaced from said second end edge and spaced from said first and second side edges; and a third opening extending through said body and disposed between said first and second openings and spaced from said first and second side edges;

a chord forming a loop;

said chord extending from said first flat surfaces through said first opening and around the rappel rope adjacent said second flat surface and back through said first opening to said first flat surface;

said chord further extending from said first opening across said first flat surface to and through said third opening and around the rappel rope and back through said second opening to said first flat surface;

said chord further extending across said first flat surface to and through said second opening and around the rappel rope and back through said second opening to said first flat surface;

a first end portion of said loop extending from said first opening and a second end portion of said loop extending from said second opening; and said second end portion of said loop extending through said first end portion of said loop to form a stirrup for a foot of a person ascending the rappel rope.

* * * * *